US012338567B2

(12) United States Patent
Kandasamy et al.

(10) Patent No.: US 12,338,567 B2
(45) Date of Patent: Jun. 24, 2025

(54) ADDITIVE ACCESSORY FOR AN AGITATOR POST IN A WASHING MACHINE APPLIANCE

(71) Applicant: Haier US Appliance Solutions, Inc., Wilmington, DE (US)

(72) Inventors: Senthil Kandasamy, Louisville, KY (US); Troy Marshall Wright, Louisville, KY (US); Isaiah Littlejohn, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 116 days.

(21) Appl. No.: 18/304,017

(22) Filed: Apr. 20, 2023

(65) Prior Publication Data

US 2024/0352648 A1 Oct. 24, 2024

(51) Int. Cl.

| | |
|---|---|
| ***D06F 39/02*** | (2006.01) |
| ***D06F 23/04*** | (2006.01) |
| ***D06F 37/12*** | (2006.01) |

(52) U.S. Cl.

CPC ..... *D06F 39/024* (2013.01); *D06F 23/04* (2013.01); *D06F 37/12* (2013.01)

(58) Field of Classification Search

None

See application file for complete search history.

(56) References Cited

U.S. PATENT DOCUMENTS

| | | | | |
|---|---|---|---|---|
| 3,466,900 | A | 9/1969 | Elliott, Jr. | |
| 3,724,242 | A | 4/1973 | Davis | |
| 4,186,574 | A | 2/1980 | Sundstrom | |
| 4,656,844 | A * | 4/1987 | Mulder | D06F 39/024 68/17 A |
| 7,069,752 | B2 | 7/2006 | Clark et al. | |
| 10,151,058 | B2 | 12/2018 | Carpenter et al. | |
| 2004/0016267 | A1* | 1/2004 | Clark | D06F 13/02 68/133 |
| 2022/0251759 | A1 | 8/2022 | Lee et al. | |

* cited by examiner

*Primary Examiner* — Cristi J Tate-Sims

(74) *Attorney, Agent, or Firm* — Dority & Manning, P.A.

(57) ABSTRACT

A washing machine appliance includes a cabinet; a tub rotatably provided within the cabinet; an agitator provided within the tub, the agitator defining an axial direction, a radial direction, and a circumferential direction, the axial direction being parallel to the vertical direction. The agitator defines a receiving space; a cup assembly received within the receiving space along the axial direction, the cup assembly including a cup and a cap; and a restrictor tube received within the receiving space along the axial direction below the cup assembly along the vertical direction.

16 Claims, 3 Drawing Sheets

ADDITIVE ACCESSORY FOR AN AGITATOR POST IN A WASHING MACHINE APPLIANCE

FIELD OF THE INVENTION

The present subject matter relates generally to laundry treatment appliances, and more particularly to agitator post accessories for washing machine appliances.

BACKGROUND OF THE INVENTION

A vertical axis washing machine appliance generally includes a tub with a basket rotatably positioned within the tub. Articles to be washed, such as clothes, are placed in the machine's basket. An agitation element can be included in the tub and can rotate to move articles within the basket to facilitate washing. Agitation elements are typically impellers, single-action agitation elements, or dual-action agitation elements. Generally, such an agitation element reciprocates about a rotation axis (e.g., vertical axis) within the machine's basket. In some instances, fins extend from a rigid shaft of the agitation element to contact and move the articles. The surface of the basket and gravity may be used in conjunction with such agitation elements to impart a circular motion of the articles, known as "turnover," from a top of the basket, to a bottom of the basket, and back up to the top of the basket.

Some agitation elements include additive storage modules provided therein. For instance, a removable cup capable of receiving an additive (e.g., fabric softener) may be positioned within the agitation element. The removable cup may be received axially into a top of the agitation element. The additive may then be selectively added to the cup before a washing operation. The additive may then be supplied to the tub or basket during the washing operation. However, there are certain drawbacks with existing additive storage modules. For instance, additives within the storage module may leak from the storage module during a high speed spin operation of the washing machine (e.g., before or after the contents are added to the basket). The leaked additive can cause unwanted degradation of elements within the washing machine.

Accordingly, a washing machine appliance that obviates one or more of the above-mentioned drawbacks would be beneficial. In particular, an agitator cup assembly that reduces leaks would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet; a tub rotatably provided within the cabinet; an agitator provided within the tub, the agitator defining an axial direction, a radial direction, and a circumferential direction, the axial direction being parallel to the vertical direction, wherein the agitator defines a receiving space; a cup assembly received within the receiving space along the axial direction, the cup assembly including a cup and a cap; and a restrictor tube received within the receiving space along the axial direction below the cup assembly along the vertical direction.

In another exemplary aspect of the present disclosure, an additive cup assembly for an agitator for a washing machine appliance is provided. The additive cup assembly defines an axial direction, a radial direction, and a circumferential direction. The additive cup assembly includes a cup defining a basin and a top rim; a cap provided radially outward from the cup and defining a cylindrical wall projecting along the axial direction; and a restrictor tube received within the agitator along the axial direction below the cup assembly along the axial direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
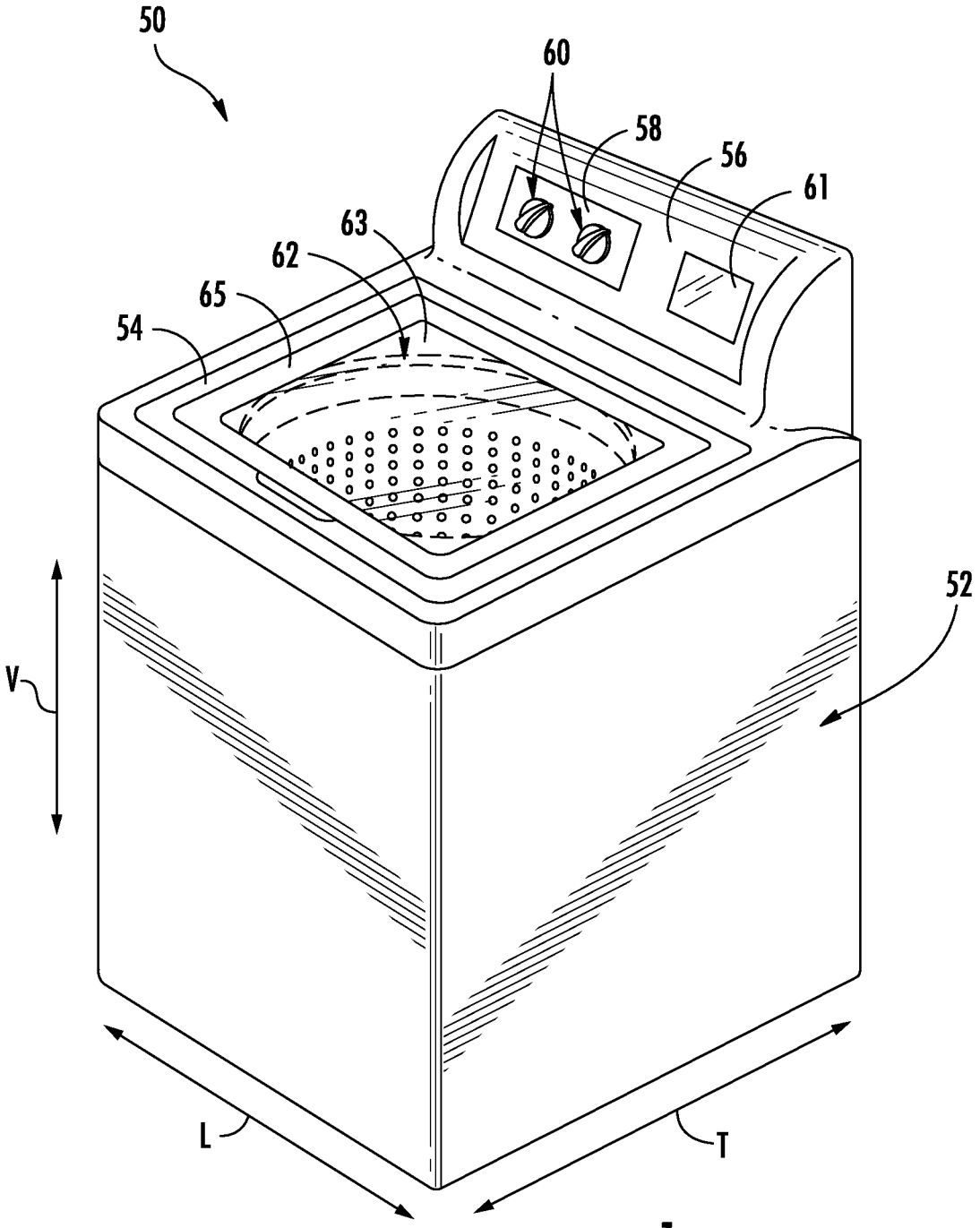
FIG. 1 provides a perspective view of a washing machine appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
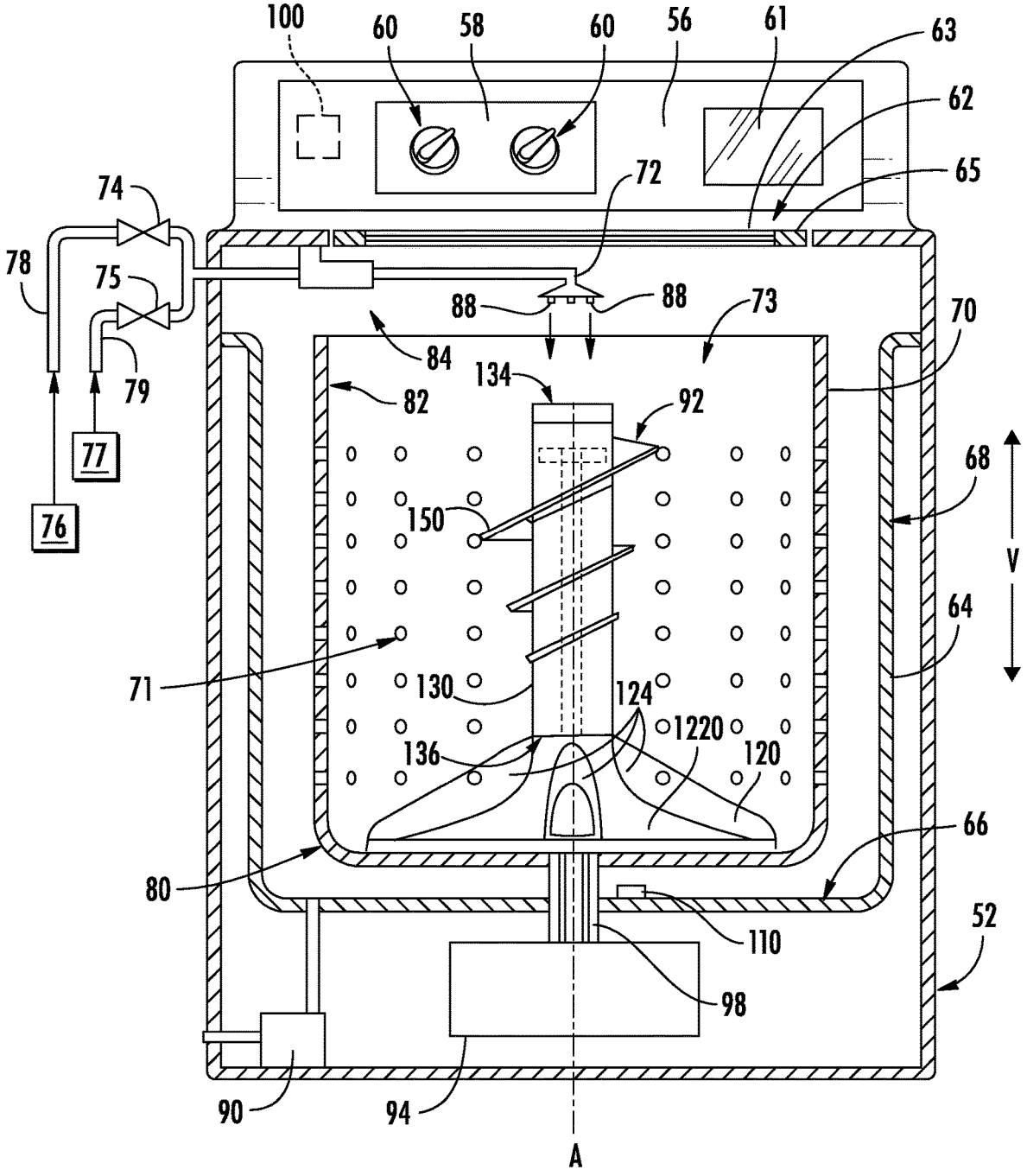
FIG. 2 provides a sectional elevation view of the exemplary washing machine appliance of FIG. 1.

Turning now to the figures, FIGS. 1 and 2 provide separate views of a washing machine appliance 50 according to exemplary embodiments of the present disclosure. As shown, washing machine appliance 50 generally defines a vertical direction V, a lateral direction L, and a transverse direction T. The vertical direction V, lateral direction L, and transverse direction T are each mutually perpendicular and form an orthogonal direction system.

Washing machine appliance 50 may include a cabinet 52 and a cover 54. A backsplash 56 may extend from cover 54, and a control panel 58, including a plurality of input selectors 60, may be coupled to backsplash 56.

Control panel 58 and input selectors 60 collectively form a user interface input for operator selection of machine cycles and features, and in one embodiment, a display 61 indicates selected features, a countdown timer, or other items of interest to machine users. It should be appreciated, however, that in other exemplary embodiments, the control panel 58, input selectors 60, and display 61, may have any other suitable configuration. For example, in other exemplary embodiments, one or more of the input selectors 60 may be configured as manual "push-button" input selectors, or alternatively may be configured as a touchscreen (e.g., on display 61).

A lid 62 may be mounted to cover 54 and rotatable between an open position (not shown) facilitating access to a tub, also referred to as a wash tub, 64 located within cabinet 52 and a closed position (FIG. 1) forming an enclosure over tub 64. Lid 62 in exemplary embodiment includes a transparent panel 63, which may be formed of, for example, glass, plastic, or any other suitable material. The transparency of panel 63 allows users to see through panel 63, and into tub 64 when lid 62 is in the closed position. In some embodiments, panel 63 itself can generally form lid 62. In other embodiments, lid 62 includes panel 63 and a frame 65 surrounding and encasing panel 63. Alternatively, panel 63 need not be transparent.

As may be seen in FIG. 2, tub 64 includes a bottom wall 66 and a sidewall 68. A wash drum or basket 70 is rotatably mounted within tub 64. In particular, basket 70 is rotatable about a central axis, which may when properly balanced and positioned in the embodiment illustrated be a vertical axis. Thus, washing machine appliance 50 may be generally referred to as a vertical axis washing machine appliance. Basket 70 may define a wash chamber 73 for receipt of articles for washing and may extend, for example, vertically, between a bottom portion 80 and a top portion 82. Basket 70 may include a plurality of openings or perforations 71 therein to facilitate fluid communication between an interior of basket 70 and tub 64.

A nozzle 72 is configured for flowing or supplying a liquid into tub 64. In particular, nozzle 72 may be positioned at or adjacent to top portion 82 of basket 70. Nozzle 72 may be in fluid communication with one or more water sources 76, 77 in order to direct liquid (e.g. water) into tub 64 or onto articles within chamber 73 of basket 70. Nozzle 72 may further include apertures 88 through which water may be sprayed into the tub 64. Apertures 88 may, for example, be tubes extending from nozzles 72 as illustrated, or simply holes defined in the nozzles 72 or any other suitable openings through which water may be sprayed. Nozzle 72 may additionally include other openings, holes, etc. (not shown) through which water may be flowed (i.e. sprayed or poured) into tub 64.

Various valves may regulate the flow of fluid through nozzle 72. For example, a flow regulator may be provided to control a flow of hot or cold water into the wash chamber of washing machine appliance 50. For the embodiment depicted, the flow regulator includes a hot water valve 74 and a cold water valve 75. The hot and cold water valves 74, 75 are used to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the washing machine appliance 50. The cold water valve 75 may be in fluid communication with a cold water source 77, which may be external to the washing machine appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing a wash additive, such as detergent, bleach, etc., into the tub 64. For example, dispenser 84 may be in fluid communication with nozzle 72 such that water flowing through nozzle 72 flows through dispenser 84, mixing with wash additive at a desired time during operation to form a liquid or wash fluid, before being flowed into tub 64. For the embodiment depicted, nozzle 72 is a separate downstream component from dispenser 84. In other exemplary embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other exemplary embodiments, the washing machine appliance 50 may not include a dispenser, in which case a user may add one or more wash additives directly to wash chamber 73. Additionally or alternatively, a separate dispenser (or storage module) may be provided within wash chamber 73, as will be explained in further detail below. A pump assembly 90 (shown schematically in FIG. 2) may be located beneath tub 64 and basket 70 for gravity assisted flow to drain tub 64.

As will be described in greater detail herein, an agitation element (or agitator) 92 is oriented to rotate about the rotation axis A (e.g., parallel to the vertical direction V). Generally, agitation element 92 includes an impeller base 120 and extended post 130. The agitation element 92 depicted is positioned within the basket 70 to impart motion to the articles and liquid in the chamber 73 of the basket 70. More particularly, the agitation element 92 depicted is provided to impart downward motion of the articles along the rotation axis A. For example, with such a configuration, during operation of the agitation element 92 the articles may be moved downwardly along the rotation axis A at a center of the basket 70, outwardly from the center of basket 70 at the bottom portion 80 of the basket 70, then upwardly along the rotation axis A towards the top portion 82 of the basket 70. It should be noted that agitation element 92 shown and described herein is provided by way of example only, and that additional or alternative iterations of agitators may be incorporated according to specific embodiments. As will be described below, an agitator 92 including a receiving space may be used.

In optional embodiments, basket 70 and agitation element 92 are both driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64 (e.g., about rotation axis A). Washing machine appliance 50 may also include a brake assembly (not shown) selectively applied or released for respectively maintaining basket 70 in a stationary position within tub 64 or for allowing basket 70 to spin within tub 64.

Various sensors may additionally be included in the washing machine appliance 50. For example, a pressure sensor 110 may be positioned in the tub 64 as illustrated or, alternatively, may be remotely mounted in another location within the appliance 50 and be operationally connected to tub 64 by a hose (not shown). Any suitable pressure sensor 110, such as an electronic sensor, a manometer, or another suitable gauge or sensor, may be used. The pressure sensor 110 may generally measure the pressure of water in the tub 64. This pressure can then be used to estimate the height or amount of water in the tub 64. Additionally, a suitable speed sensor can be connected to the motor 94, such as to the output shaft 98 thereof, to measure speed and indicate operation of the motor 94. Other suitable sensors, such as temperature sensors, water sensors, moisture sensors, etc., may additionally be provided in the washing machine appliance 50.

Operation of washing machine appliance 50 may be controlled by a processing device or controller 100, that is operatively coupled to the input selectors 60 located on washing machine backsplash 56 for user manipulation to select washing machine cycles and features. Controller 100 may further be operatively coupled to various other components of appliance 50, such as the flow regulator (including valves 74, 75), motor 94, pressure sensor 110, other suitable sensors, etc. In response to user manipulation of the input selectors 60, controller 100 may operate the various components of washing machine appliance 50 to execute selected machine cycles and features.

While described in the context of specific embodiments of washing machine appliance 50, using the teachings disclosed herein it will be understood that washing machine appliance 50 is provided by way of example only. Other washing machine appliances having different configurations, different appearances, or different features may also be used with the present subject matter as well.

Figure 3:
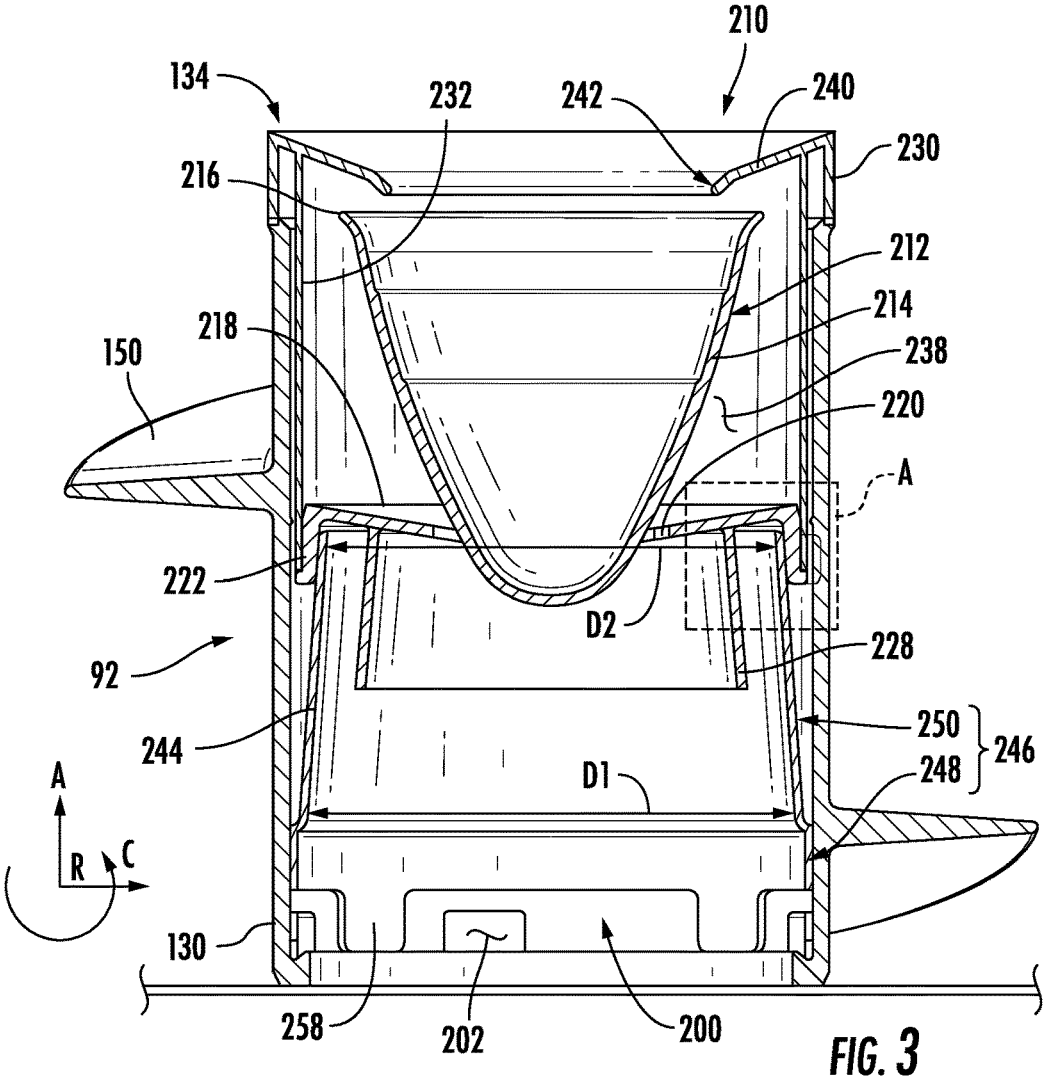
FIG. 3 provides a front section view of an agitator post of the exemplary washing machine appliance of FIG. 1.
Figure 4:
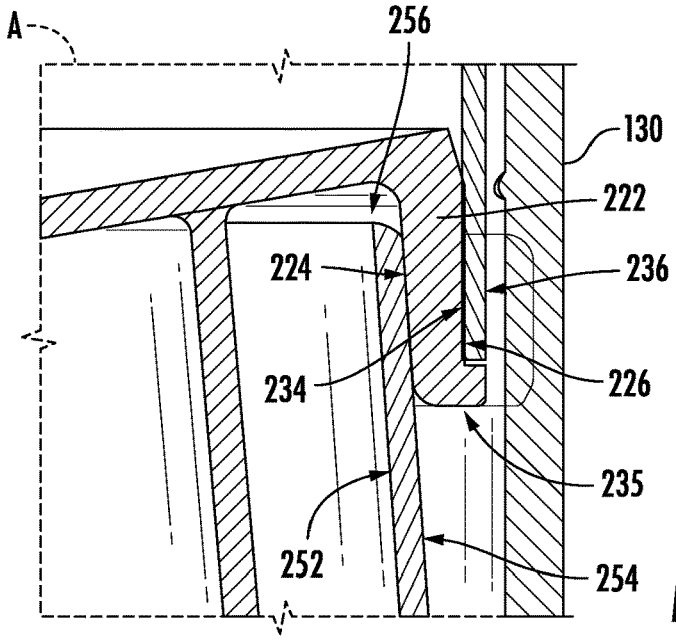
FIG. 4 provides a close-up section view of section A of the exemplary agitator post of FIG. 3.

Referring now to FIGS. 3 and 4, an embodiment of agitator 92 will be described in detail. FIG. 3 provides a section view of agitator 92. As seen in FIG. 3, agitator 92 may define an axial direction A, a radial direction R. and a circumferential direction C. According to at least some embodiments, axial direction A is predominantly parallel with vertical direction V (e.g., when washing machine appliance 50 is a top load appliance). Agitator 92 may define a receiving space 200 therein. Receiving space may be formed along the axial direction A. For instance, agitator 92 may form a hollow tube shape. Accordingly, items (e.g., additive modules), liquids (e.g., additives), or the like may be selectively accommodated within receiving space 200.

Agitator 92 may include a plurality of outlets 202 formed therein. In detail, the plurality of outlets 202 may be formed radially through agitator 92. The plurality of outlets 202 may be formed at or near a base of agitator 92 (e.g., near a bottom along the vertical direction V or axial direction A). The plurality of outlets 202 may allow fluid communication between agitator 92 (e.g., receiving space 200) and wash chamber 73. Accordingly, liquid within receiving space 200 (e.g., additive liquid) may be selectively supplied to wash chamber 73 via the plurality of outlets 202.

The plurality of outlets may be spaced equidistant about the circumferential direction C. For instance, the plurality of outlets 202 may include four outlets. It should be understood that any suitable number of outlets 202 may be provided and the disclosure is not limited to the examples given herein. According to this example, the four outlets 202 may be spaced apart from each other by about 90° (e.g., plus or minus) 10°. For instance, a circumferential distance between a center point of a first outlet and a center point of a second adjacent outlet may be about 90°. When three outlets 202 are provided, the outlets 202 may be spaced apart form each other by about 120°, and so forth. As will be described further below, a liquid additive supplied to a cup assembly provided within agitator 92 may enter wash chamber 73 via the plurality of outlets 202 during a washing operation.

Washing machine appliance 50 may include a cup assembly 210. Cup assembly 210 may be selectively received within receiving space 200 of agitator 92. For instance, cup assembly 210 may be removably inserted into receiving space 200 along the axial direction A. Accordingly, a user may remove cup assembly 210 (e.g., to clean, disinfect, or replace cup assembly 210). Cup assembly 210 may be referred to as an additive cup assembly 210. Accordingly, cup assembly 210 may selectively receive, store, or disperse an additive (e.g., liquid additive) to wash chamber 73 during a washing operation (e.g., such as fabric softener).

Cup assembly 210 may include a cup 212. Cup 212 may include or define a basin 214. As would be understood, basin 214 may define a liquid chamber in which the liquid additive is supplied. Basin 214 may be generally conical in shape.

For instance, a diameter at a bottom of basin 214 may be smaller than a diameter at a top of basin 214. Basin 214 may thus define a top rim 216. Top rim 216 may be provided at an upper portion of cup 212. Top rim 216 may be flared outward (e.g., along the radial direction R) so as to allow the fluid within basin 214 to pour out from basin 214 during a predetermined cycle of the washing operation. For instance, the conical shape of basin 214 together with the flared shape of top rim 216 may urge the fluid within cup 212 to pour over top rim 216 during a spin cycle of washing machine appliance 50.

Cup 212 may include an outer skirt 218. Outer skirt 218 may extend predominantly along the radial direction R. For instance, outer skirt 218 may extend from basin 214 along the radial direction R (e.g., toward agitator 92). According to at least some embodiments, outer skirt 218 extends at an angle with respect to basin 214. For instance, outer skirt 218 may extend axially upward along the radial direction R. In other words, a proximal portion of outer skirt 218 may be provided lower (e.g., along the axial direction A) than a distal portion of outer skirt 218. Thus, outer skirt 218 may form a generally bowl shape concaved axially upward.

Outer skirt 218 may include a plurality of apertures 220. The plurality of apertures 220 may be formed along the axial direction A. The plurality of apertures 220 may be located at or near the proximal portion of outer skirt 218 (e.g., adjacent to basin 214). For instance, the plurality of apertures 220 may be formed at or near a bottom of outer skirt 218 (e.g., when outer skirt 218 forms the generally bowl shape). The plurality of apertures 220 may allow a fluid to pass therethrough (e.g., from above outer skirt 218 to below outer skirt 218, as will be described below). The plurality of apertures 220 may be elongated along the circumferential direction C (e.g., about outer skirt 218). Any suitable number of apertures 220 may be formed, such as 2 apertures, 3, apertures, 4 apertures, or the like.

Outer skirt 218 may include an annular portion 222. Annular portion 222 may be provided at the distal portion of outer skirt 218 (e.g., adjacent to agitator 92). Annular portion 222 may extend downward (e.g., along the axial direction A) from the distal portion of outer skirt 218. Additionally or alternatively, annular portion 222 may extend along the circumferential direction C. For instance, annular portion 222 may form a ring defining an inner annular face 224 and an outer annular face 226 (FIG. 4). Outer annular face 226 may be opposite inner annular face 224 along the radial direction R. Accordingly, outer annular face 226 may face agitator 93 along the radial direction R.

Cup 212 may include an inner skirt 228. Inner skirt 228 may project or extend from outer skirt 218. For instance, inner skirt 228 may project from a bottom or bottom face of inner skirt 218. Accordingly, inner skirt 228 may extend generally downward along the axial direction A. According to at least some embodiments, inner skirt 228 has a generally conical shape (e.g., along the axial direction A). For instance, a top portion of inner skirt 228 (e.g., proximal to the bottom of outer skirt 218) may have a small diameter than a bottom portion of inner skirt 228 (e.g., distal to the bottom of outer skirt 218). Inner skirt 228 may extend a predetermined distance along the axial direction A. Additionally or alternatively, inner skirt 228 is provided radially outward from the plurality of apertures 220 defined in outer skirt 218. Accordingly, fluid flowing through the plurality of apertures 220 is provided within inner skirt 228 (e.g., radially inward).

Cup assembly 210 may include a cap 230. Cap 230 may include a cylindrical wall 232. Cylindrical wall 232 may project along the axial direction A. For instance, cylindrical wall 232 may define an outer shell including an inner face 234 and an outer face 236 opposite inner face 234 along the radial direction R. Cylindrical wall 232 may have a constant diameter along the axial direction A (i.e., cylindrical wall 232 does not taper along the axial direction A). Cylindrical wall 232 may thus surround cup 212 (e.g., basin 214) about the circumferential direction C.

A gap 238 may be provided between basin 214 of cup 212 and inner face 234 of cylindrical wall. Gap 238 may be defined circumferentially about basin 214 and cylindrical wall 232. Liquid provided within basin 214 may selectively flow into gap 238 (e.g., over top rim 216). The liquid may then selectively flow through the plurality of apertures 220 (e.g., axially toward a bottom of receiving space 200 of agitator 93). The liquid may then pass from receiving space 200 to wash chamber 73 via the plurality of radial outlets 202.

Inner face 234 of cylindrical wall 232 may face outer annular face 226 of outer skirt 218. For instance, FIG. 4 provides a close-up of inset A of FIG. 3. As seen most clearly in FIG. 4, cylindrical wall 232 overlaps outer skirt 218 of cup 212 along the radial direction R. Accordingly, outer annular face 226 of outer skirt 218 may contact inner face 234 of cylindrical wall 232. According to at least some embodiments, outer annular face 226 is attached to inner face 234. For instance, cap 230 may be fixed to cup 212 at the juncture of outer annular face 226 and inner face 234. For at least one example, cap 230 is spin welded to cup 212. However, it should be understood that any suitable connection method may be used to join cup 212 to cap 230. Advantageously, liquid (e.g., additive liquid) within gap 238 may be restricted from exiting (e.g., escaping) gap 238 via a space between cylindrical wall 232 (e.g., outer face 236) and an interior wall of agitator 93.

Cap 230 may include a brim (e.g., angled brim) 240. Brim 240 may project from a top end of cylindrical wall 232. For instance, brim 240 may project inward predominantly along the radial direction R. Additionally or alternatively, brim 240 may project downward along the axial direction A (e.g., toward a center of agitator 93). Thus, brim 240 may form a beveled surface downward and inward into receiving space 200 of agitator 93. According to at least some embodiments, a lip 242 of brim 240 overlaps top rim 216 of basin 214.

Additionally or alternatively, brim 240 may be spaced apart from top rim 216 by a predetermined amount. For instance, brim 240 may be spaced apart from top rim 216 along each of the axial direction A and the radial direction R. A diameter of basin 214 at top rim 216 may be larger than a diameter of lip 242 of brim 240. Accordingly, liquid that spills over top of top rim 216 may be restricted from overflowing over a top of brim 240 and into wash basket 70.

Washing machine appliance 50 may include a restrictor tube 244. According to some embodiments, restrictor tube 244 is provided as a removable part of cup assembly 210. For instance, restrictor tube 244 may be disconnected from cup assembly 210 (e.g., cup 212 and cap 230). Restrictor tube 244 may be provided within receiving space 200 along the axial direction A. For instance, restrictor tube 244 may be provided below cup assembly 210 along the axial direction A (or vertical direction V). Restrictor tube 244 may include a tubular wall 246. Tubular wall 246 may extend predominantly along the axial direction A (e.g., within receiving space 200).

Tubular wall 246 may include or define a first portion 248 and a second portion 250. First portion 248 may have a generally constant diameter (e.g., within a predetermined percentage). For instance, first portion 248 may extend for a first length along the axial direction A. A diameter of first portion 248 along the first length may be constant (e.g., cylindrical). First portion 248 may be provided at or near a bottom of tubular wall 246 (e.g., along the axial direction A or vertical direction V). Second portion 250 may extend from first portion 248 predominantly upward along the axial direction A. Second portion 250 may extend for a second length, the second length being greater than the first length. Second portion 250 may have a varying diameter along the second length. For instance, a diameter D1 of second portion 250 at a base thereof (e.g., proximate to first portion 248) may be larger than a diameter D2 of second portion 250 at a top thereof (e.g., distal to first portion 248). Thus, second portion 250 may be conical or funnel in shape.

Tubular wall 246 (e.g., second portion 250) may define an inner radial surface 252 and an outer radial surface 254 opposite inner radial surface 252 (e.g., along the radial direction R). A top portion of outer radial surface 254 may contact inner annular face 224 of outer skirt 218. For instance, annular portion 222 of outer skirt 218 may be sandwiched between second portion 250 of tubular wall 246 and cylindrical wall 232 of cap 230. Additionally or alternatively, a top edge 256 of second portion 250 may be provided above a bottom edge 235 of annular portion 222 along the axial direction A. Advantageously, remaining liquid provided within receiving space 200 (e.g., within restrictor tube 244) may be prevented from climbing an interior wall of agitator 93 during a high speed spin cycle.

Restrictor tube 244 may include a plurality of tabs 258. The plurality of tabs 258 may protrude downward along the axial direction A (or vertical direction V) from first portion 248 of tubular wall 246. In detail, the plurality of tabs 258 may be provided at a radial edge of first portion 248. The plurality of tabs 258 may include any suitable number of tabs, such as three tabs, four tabs, five tabs, or the like. Each of the plurality of tabs 258 may be spaced equidistant from each other about the circumferential direction C. For instance, in the instance where three tabs are provided, the three tabs 258 are separated from each other by about 120°. For instance, a circumferential distance between a center point of a first tab and a center point of a second adjacent tab may be about 120°. Accordingly, a bottom of first portion 250 may be prevented from bottoming out within receiving space 200. Thus, the plurality of radial outlets 202 within agitator 93 may remain open to allow fluid communication between the receiving space 200 and the wash chamber 73. Additionally or alternatively, the number of tabs 258 may be different from the number of radial outlets 202. For one example, when four outlets 202 are provided, three tabs 258 are provided. Accordingly, a positioning of tabs 258 with respect to radial outlets 202 may ensure that fluid communication between receiving space 200 and wash chamber 73 remains open.

According to an additive operation of washing machine appliance 50, the liquid additive (e.g., fabric softener) accommodated within cup 212 may be supplied to gap 238 by spilling over top rim 216. Brim 240 may prevent the additive from escaping or spilling over a top of cap 230. Once temporarily stored within gap 238, the additive may flow through apertures 220 (e.g., downward along the axial direction A). The additive may be restrained along the radial direction by each of inner skirt 228 and restrictor tube 244. The additive may then be supplied to wash chamber 73 via radial outlets 202 in agitator 93. Residual additive fluid may be restricted from further escaping receiving space 200 by the connection point between outer face 254 of tubular wall 246, annular portion 222 of outer skirt 218, and cylindrical wall 232 of cap 230. Advantageously, damage to wash basket 70 may be minimized, prolonging a life of the basket and reducing the need for repair or replacement.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical direction, a lateral direction, and a transverse direction, the washing machine appliance comprising:
- a cabinet;
- a tub rotatably provided within the cabinet;
- an agitator provided within the tub, the agitator defining an axial direction, a radial direction, and a circumferential direction, the axial direction being parallel to the vertical direction, wherein the agitator defines a receiving space;
- a cup assembly received within the receiving space along the axial direction, the cup assembly comprising:
  - a cup;
  - a cap;
  - a basin defining a top rim;
  - an outer skirt extending radially from the basin, the outer skirt comprising an inner annular face and an outer annular face opposite the inner annular face along the radial direction; and
  - an inner skirt defining a conical shape and projecting axially from a bottom face of the outer skirt; and
- a restrictor tube received within the receiving space along the axial direction below the cup assembly along the vertical direction.

2. The washing machine appliance of claim 1, wherein the cap comprises:
- a cylindrical wall projecting along the axial direction and defining an inner face and an outer face; and
- a brim projecting radially inward from the cylindrical wall, the brim being spaced apart from the top rim of the basin by a predetermined distance.

3. The washing machine appliance of claim 2, wherein the outer annular face of the outer skirt of the cup is spin welded to the inner face of the cylindrical wall of the cap.

4. The washing machine appliance of claim 1, wherein the restrictor tube comprises:
- a tubular wall extending along the axial direction, the tubular wall defining a first portion having a constant diameter along a first axial length and a second portion having a varying diameter along a second axial length; and
- a plurality of tabs protruding downward along the axial direction from the first portion of the tubular wall.

5. The washing machine appliance of claim 4, wherein the agitator comprises a plurality of radial outlets allowing fluid communication between the receiving space and the tub, the plurality of radial outlets being defined at a bottom of the agitator.

6. The washing machine appliance of claim 5, wherein the plurality of tabs comprises four tabs spaced equidistant about the circumferential direction, and wherein the plurality of radial outlets comprises three radial outlets spaced equidistant about the circumferential direction.

7. The washing machine appliance of claim 1, wherein the restrictor tube defines an inner radial surface and an outer radial surface opposite the inner radial surface.

8. The washing machine appliance of claim 7, wherein the outer radial surface of the restrictor tube contacts the inner annular face of the outer skirt of the cup.

9. An additive cup assembly for an agitator for a washing machine appliance, the additive cup assembly defining an axial direction, a radial direction, and a circumferential direction, the additive cup assembly comprising:

a cup defining a basin and a top rim;

a cap provided radially outward from the cup and defining a cylindrical wall projecting along the axial direction an outer skirt extending radially from the basin, the outer skirt comprising an inner annular face and an outer annular face opposite the inner annular face along the radial direction;

an inner skirt defining a conical shape and projecting axially from a bottom face of the outer skirt; and a restrictor tube received within the agitator along the axial direction below the cup assembly along the axial direction.

10. The additive cup assembly of claim 9, wherein the outer skirt defines a plurality of apertures along the axial direction.

11. The additive cup assembly of claim 9, wherein the cylindrical wall defines an inner face and an outer face, and wherein the cap comprises:

a brim projecting radially inward from the cylindrical wall, the brim being spaced apart from the top rim of the cup by a predetermined distance.

12. The additive cup assembly of claim 11, wherein the outer annular face of the outer skirt of the cup is spin welded to the inner face of the cylindrical wall of the cap.

13. The additive cup assembly of claim 9, wherein the restrictor tube comprises:

a tubular wall extending along the axial direction, the tubular wall defining a first portion having a constant diameter along a first axial length and a second portion having a varying diameter along a second axial length; and a plurality of tabs protruding downward along the axial direction from the first portion of the tubular wall.

14. The additive cup assembly of claim 13, wherein the plurality of tabs comprises four tabs spaced equidistant about the circumferential direction.

15. The additive cup assembly of claim 9, wherein the restrictor tube defines an inner radial surface and an outer radial surface opposite the inner radial surface.

16. The additive cup assembly of claim 15, wherein the outer radial surface of the restrictor tube contacts the inner annular face of the outer skirt of the cup.

* * * * *